US006380963B1

(12) United States Patent
Butcher

(10) Patent No.: US 6,380,963 B1
(45) Date of Patent: Apr. 30, 2002

(54) CARRIER UTILIZATION IN PRINTING

(75) Inventor: James Butcher, Bottesford (GB)

(73) Assignee: Markem Technologies Limited, Nottingham (GB)

( * ) Notice: Subject to any disclaimer, the term of this patent is extended or adjusted under 35 U.S.C. 154(b) by 0 days.

(21) Appl. No.: 09/437,361

(22) Filed: Nov. 10, 1999

(30) Foreign Application Priority Data

Nov. 13, 1998 (GB) ..... 9824839

(51) Int. Cl.[7] ..... B41J 2/325
(52) U.S. Cl. ..... 347/215; 400/231; 400/120.05
(58) Field of Search ..... 347/37, 40, 42, 347/215, 217; 400/223, 224.1, 224.2, 217, 231, 120.05, 120.01

(56) References Cited

U.S. PATENT DOCUMENTS

| | | | | | |
|---|---|---|---|---|---|
| 4,787,763 | A | | 11/1988 | Kondo | |
| 5,908,251 | A | * | 6/1999 | Buckby | 400/231 |
| 6,019,527 | A | * | 2/2000 | Green | 400/208 |

FOREIGN PATENT DOCUMENTS

| | | | | |
|---|---|---|---|---|
| EP | 0 635 368 | A3 | 1/1995 | |
| EP | 0 635 368 | A2 | 1/1995 | |
| EP | 0 842 785 | A1 | 5/1998 | |
| GB | 2289441 | B | 11/1995 | B41J/33/54 |
| GB | 2289652 | A | 11/1995 | B41J/33/54 |
| WO | WO 99/34983 | | 7/1999 | |

* cited by examiner

*Primary Examiner*—Judy Nguyen
(74) *Attorney, Agent, or Firm*—Fish & Richardson P.C.

(57) ABSTRACT

Multiple images are printed utilizing lateral sets of print elements on a printhead and lateral portions of a ribbon.

11 Claims, 5 Drawing Sheets

CARRIER UTILIZATION IN PRINTING

BACKGROUND TO THE INVENTION

This invention relates to a method of printing.

In pixel based printing systems such as dot matrix ribbon printing, or thermal transfer printing which utilises a carrier or carrier which carries print medium such as ink, (known in thermal printing, as ribbon or foil), one major expense for a user is the cost of the ribbon or foil.

SUMMARY OF THE INVENTION

According to the invention we provide a method of printing utilising a printing apparatus having a print head with an array of printing elements each of which is individually selectable in a plurality of pixel row positions along an adjacent substrate to transfer a pixel of print medium from a carrier onto the adjacent substrate, the array extending laterally with respect to a direction of relative movement between the carrier and substrate, and the print head, characterised in that the method includes the steps of (a) carrying out a first printing operation by means of causing relative movement between the substrate and carrier, and the print head, such that the print head moves relative to a first area of the carrier from a start position to an end position whilst printing elements from a first set of adjacent printing elements of the laterally extending array are selected to transfer a first set of pixels of print medium from the area of the carrier onto the substrate to produce an image having height less than one half of the width of the carrier;

(b) causing relative movement between the print head and the carrier to reposition the print head at the start position of the carrier;

(c) causing relative movement between the carrier and the substrate to present fresh substrate adjacent to the area of the carrier, and (d) carrying out a second printing operation by means of causing relative movement between the fresh substrate and carrier, and the print head, such that the print head moves again relative to the area of the carrier from the start position to the end position whilst printing elements from a second set of adjacent printing elements laterally disposed with respect to the first set of adjacent printing elements are selected to transfer a second set of pixels of print medium from the area of the carrier onto the fresh substrate, to produce a second image having a height less than one half of the width of the carrier.

The invention offers a way for a user to save the cost of thermal printing ribbon or foil, or other carrier and print medium where the image to be printed is substantially narrower than i.e. at least half of the width of the carrier.

By "fresh substrate" we mean an entirely fresh substrate, such as a different label, or a further part of the same substrate, onto which pixels of print medium have not previously been transferred from the carrier.

By means of the invention, two separate substrates or separate areas of substrate can be printed for example, with the same information, but the printing apparatus only consumes one area of ribbon or foil.

Particularly where the image is very narrow compared to the width of the carrier, the method may be repeated several times for the same area of carrier, with each relative movement between substrate and carrier, and the print head, utilising a different set of printing elements to transfer different pixels of print medium onto substrate.

After each printing operation the printing head may be moved e.g. laterally, away from the carrier and substrate, and held a short distance away from the carrier whilst the carrier and/or substrate are moved in preparation for the next printing operation, and then moved e.g. laterally, back towards the carrier and substrate.

In one embodiment, the relative movement between the substrate and carrier, and the print head, is produced by movement of the print head whilst the substrate and carrier are held generally stationary relative to a base.

In another embodiment, the relative movement between the substrate and carrier, and the print head, is produced by movement of the substrate and carrier whilst the print head is held generally stationary relative to a base.

The invention is particularly but not exclusively applicable to thermal transfer printing, where the print medium comprises ink carried on a carrier comprising a continuous backing carrier, and the printing elements are energised to produce heat to transfer pixels of ink from the carrier onto a substrate.

In such an application, there are typically at least six, commonly eight or twelve or more printing elements per millimetre of printing head, arranged in a single line array. The printing elements may, however, be arranged in a multiple line, or other non-single line array.

However the invention may be applied to any other dot based printing system such as a dot matrix printer which utilises a woven ribbon as a carrier for ink and where printing elements are arranged in an array.

According to a second aspect of the invention we provide a printing apparatus adapted for performing the method of the first aspect of the invention.

BRIEF DESCRIPTION OF THE DRAWINGS

The invention will now be described with reference to the accompanying drawings in which.

DESCRIPTION OF THE PREFERRED EMBODIMENTS

Figure 1:
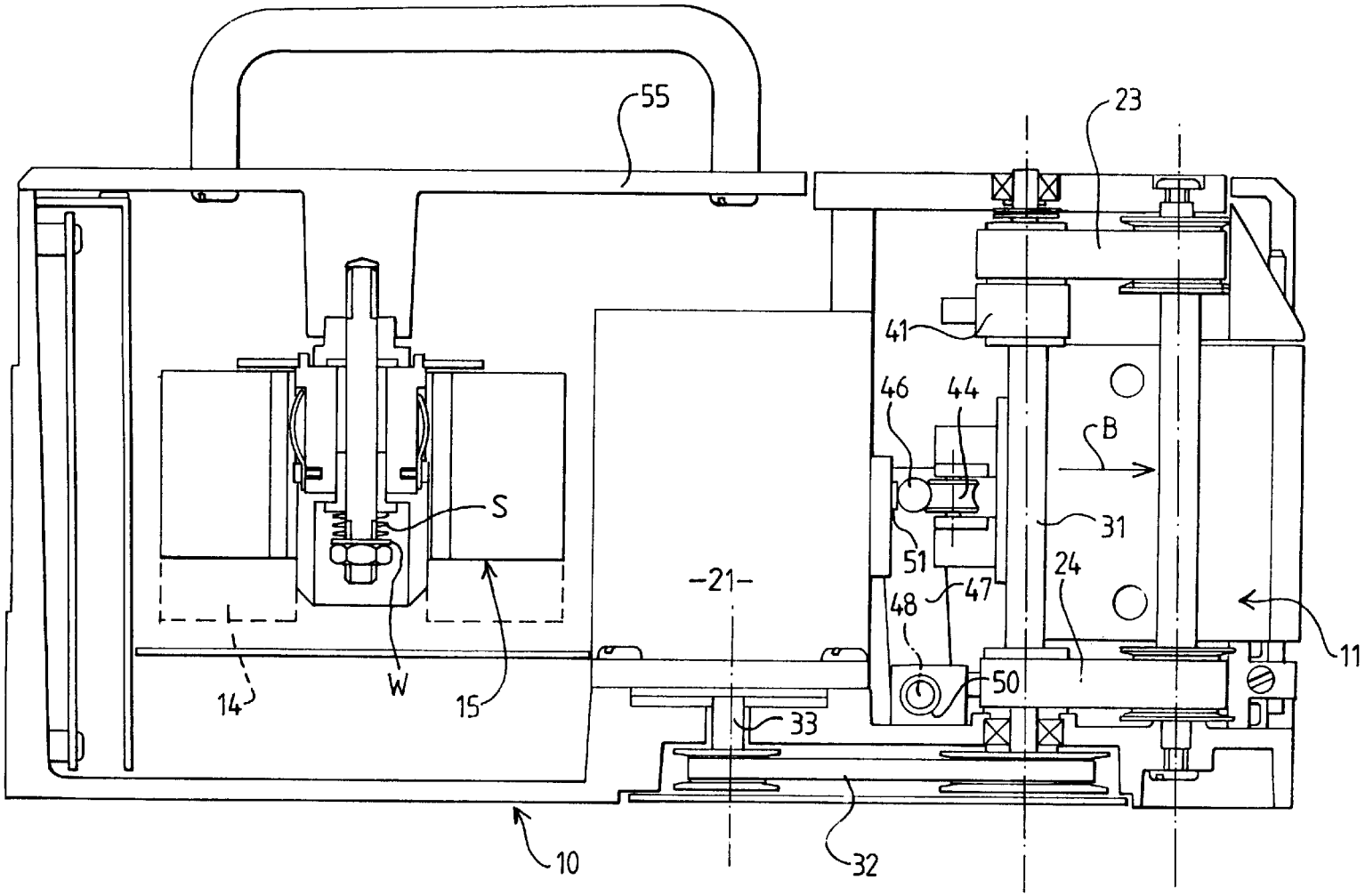
FIG. 1 is a side illustrative view of a printing apparatus which may be operated by a method in accordance with the invention, without a print medium carrying carrier being shown, for clarity.
Figure 2:
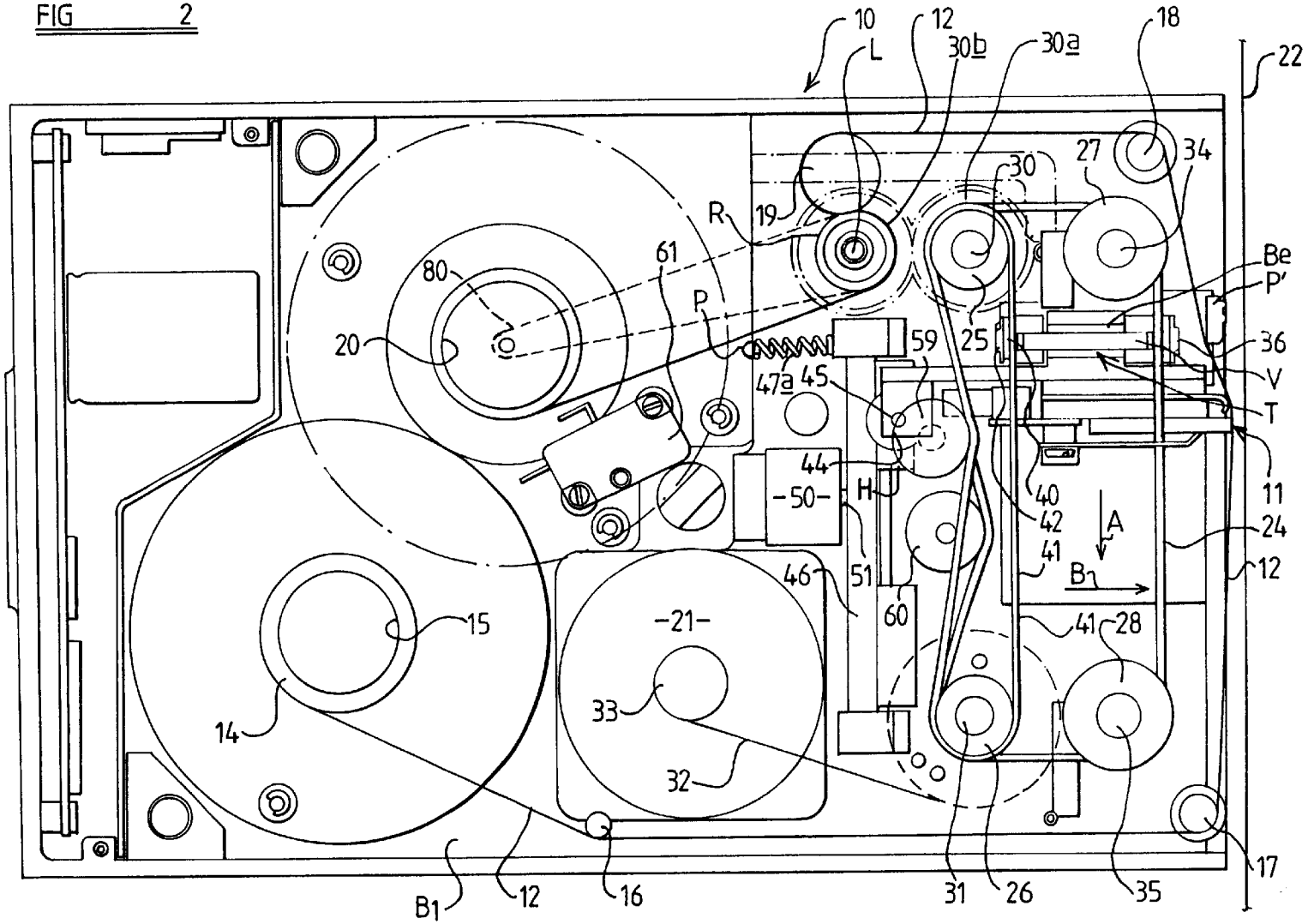
FIG. 2 is a top plan view of the printing apparatus of FIG. 1, showing the print medium carrying carrier.
Figure 3:
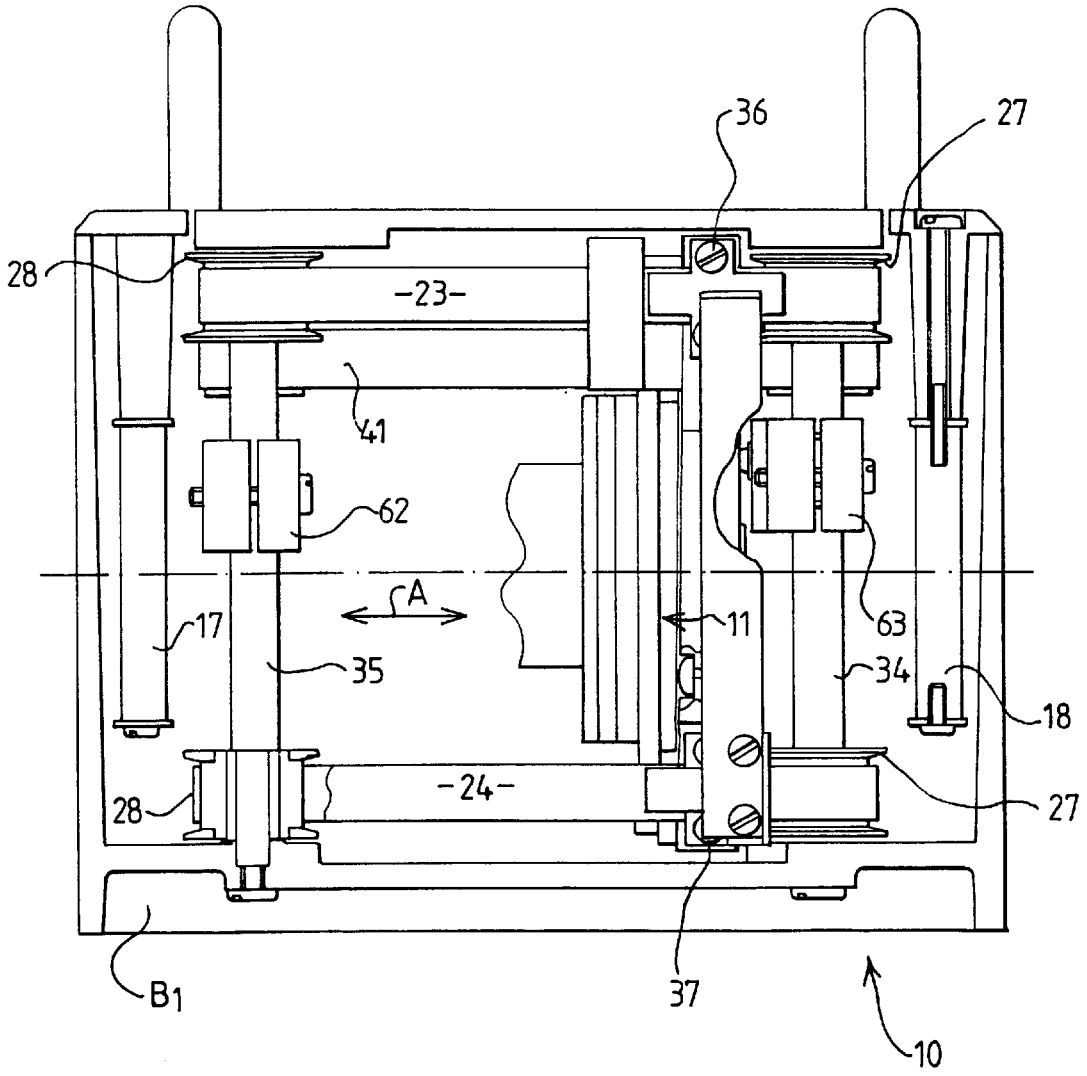
FIG. 3 is a front illustrative view of the printing apparatus of FIG. 1 again without the print medium carrying carrier for clarity.

Referring to FIGS. 1 to 3, there is shown a printing apparatus 10 comprising a print head assembly 11 which mounts a plurality of individually energisable thermal printing elements, preferably provided at an edge of the print head assembly 11, in a single line array. The print head assembly 11 is movable relative to carrier, being a carrier 12 which carries print medium comprising ink, whilst the thermal printing elements are individually selectively energised under computer control, wherein the elements will become hot, thus to cause pixels of ink to be removed from the carrier 12 and deposited onto a substrate 22 to the right hand side of the apparatus 10 as seen in FIG. 1. The substrate may for example be a label which is subsequently applied to an article, or packaging material, or may be the article itself, which substrate moves past the printing apparatus 10 and is temporarily halted at the printing apparatus 10 whilst printing thereon is effected.

In this way, information can be printed, in ink, on the substrate.

The information usually is, one or more alpha-numeric characters, to indicate for example, a sell-by date. The or each such character is defined by a plurality of pixels of print medium i.e. ink, transferred from the carrier 12 by the energised printing elements of the printing head assembly 11 as the print head assembly 11 is moved relative to the carrier and substrate.

The carrier 12 carrying the ink is provided on a supply spool 14 carried on a hub 15, the carrier 12 passing around a carrier guide path comprising idler rollers 16,17,18, around a further roller 19 between the roller 19 and a drive roller R and then on to a take up spool mounted on a hub 20. The drive roller R and take up spool are driven, as hereinafter explained, from a motive means 21 which is in this example, a stepper motor.

The hub 15 and hence spool 14 provides some resistance to carrier 12 being paid out therefrom, this being provided by a friction means being a clutch material W and a spring S configured as is well known in the art. The take up spool is also mounted on a hub 20 having a similar friction means.

The print head assembly 11 is driven for movement relative to the carrier 12 by the motor 21 via a transmission. The transmission comprises a pair of generally parallel spaced apart flexible drive members comprising belts 23,24, which are entrained respectively about pairs of rollers 25,26, and rollers 27,28.

The first pair of rollers 25,26, are mounted on respective generally parallel and vertical drive shafts 30,31, with shaft 31 being driven via a belt 32 or chain drive or otherwise as required, from an output shaft 33 of the stepper motor 21.

The second pair of rollers 27,28, are each mounted on respective generally parallel and vertical shafts 34,35, via bearings so that the rollers 27,28, are free to rotate relative to their respective shafts 34,35.

Drive shaft 30 has secured to it, a gear 30*a* which meshes with a gear 30*b* on a shaft L on which roller R is provided.

As can be seen from FIG. 1, the print head assembly 11 is of generally rectangular configuration, and is secured to a mounting structure T which is clamped at screws 36,37, (see FIG. 3) to the belts 23,24. Upon operation of the motor 21 drive is transmitted from the drive shaft 33 of the motor to each of the belts 23,24, via the shaft 31, and hence the print head assembly 11 is caused to move either in the direction indicated by arrow A, relative to the carrier 12, or an opposite direction depending upon the sense of rotation of the output shaft 33 of the motor 21.

The structure T comprises a slider element V and a bearing Be and which is fixed relative to the print head assembly 11 and is slidable relative to the slider element V. Hence the print head assembly 11 can slide in the direction of arrow B and in an opposite direction, relative to the slider element V.

The mounting structure T is also clamped at its rear edge 40 to a third belt 41 as shown at 42 in FIG. 2, the third belt 41 being driven in synchronism with belts 23,24, from shaft 31, but being entrained only about the shafts 31 and 30.

The print head assembly 11 also carries at its rear edge, a guide roller 44 which is rotatable about a generally vertical axis 45 transverse to the direction A of movement of the print head assembly 11 during printing. The roller 44 bears on a generally horizontal post 46 of generally circular cross section, the post being mounted via a lever arm 47 for rotation about a horizontal axis 48 generally parallel to but spaced from the post 46, on a bearing 50 which is fixed relative to a body of the printing assembly 10.

Hence as the print head assembly 11 moves from side to side, in the direction of arrow A or oppositely, the print head assembly 11 is guided for movement via the guide roller 44 and post 46.

A strong spring 47*a* is provided between the post 46 and a frame part P of the apparatus 10 to bias the post 46 about axis 48 away from the print head. assembly 11. The print head assembly 11 carries a hook formation H which engages with post 46 so that as the post 46 moves in the direction generally opposite to that of arrow B, the print head assembly 11 is moved with it, and slides relative to the mounting structure T.

The amount that the post 46 can be moved by the spring 47*a* is restricted by means of an air cylinder 50 which is positioned behind the post 46.

In the figures, the print head assembly 11 is shown in a start position spaced away from a substrate 22, but with the carrier 12 carrying the ink, entrained over an edge of the print head assembly 11 mounting the thermal printing elements.

To bring the print head assembly 11 towards the carrier 12 and substrate to effect printing, the print head assembly 11 is moved in a direction indicated by arrow B, i.e. laterally, which is transverse to the direction of movement of the print head assembly 11 during printing, as indicated by arrow A.

Movement of the post 46 and hence of the print head assembly 11 in direction B is achieved by means of the air cylinder 50 and its piston 51, which, when actuated, rotates the guide post 46 about axis 48, thus to urge the print head assembly 11 towards the substrate 22, against the restoring force of the spring 472. The piston 51 is arranged to retain the print head assembly 11 in its extended position against the restoring force of the springs 47*a*, whilst the print head assembly 11 moves from the beginning, to end of printing positions in direction of arrow A, to effect printing on the substrate.

At the end of printing, when the print head assembly 11 is in its end of printing position, the piston 51 is deactuated and the print head assembly 11 is moved in an opposite direction to arrow B by the restoring force of the spring 47*a* away from the substrate and, by actuating the motor 21 in an opposite sense of rotation, the print head assembly 11 is moved back to the start position shown in the drawings in a direction opposite to the direction of arrow A.

The hub 20 of the take up spool carried by hub 20 is driven from the motor 21 via a drive belt 80 shown in dotted lines in FIG. 2, which is fixed to rotate with the drive roller R. Between drive roller R and the shaft L which is rotated by gear 30*b*, there is a mechanical one-way clutch which permits the shaft L to rotate relative to the roller R as the stepper motor 21 rotates in one sense of rotation (clockwise in FIG. 2) during a printing operation. Thus the carrier 12 and take-up spool 20 remain stationary during a printing operation as the extended print head 11 moves downwardly as seen in FIG. 2. A one-way clutch suitable for this purpose is well known in itself and is a purely mechanical unit.

Of course, when the stepper motor 21 is rotated in an opposite sense of rotation, in the absence of any other means, the one-way clutch would cause the drive roller R to rotate clockwise as seen in FIG. 2, and thus drive the carrier 12 which is entrained about it, as well as the take up spool 20, so that the carrier 12 advances as the print head assembly 11 is moved back to the start of print position indicated in the drawings.

To enable the apparatus 10 to operate in accordance with the present invention, there is provided a further clutch between the gear 30*b* and shaft L so that during the return movement of the printing head 11 to the start of print position, the shaft L and hence the drive roller R can be prevented from rotating with the gear 30*b*. Such a clutch preferably comprises an electrically operated clutch which is under the control of the computer control of the apparatus.

Further features of the printing apparatus are as follows.

In this embodiment described, the spools 14 and spool carried by hub 20 as well as the drive roller R (but not its shaft L) and idler rollers 19, 18 and 17 are carried by a cassette 55 which can be removed from the body of the printing apparatus 10 to facilitate replenishing the printing apparatus 10 with carrier 12.

The carrier guide path includes a peeler bar P' behind which the carrier 12 passes immediately after passing over the print head assembly 11, the bar P' being operable to ensure proper separation of ink deposited on the substrate, and remaining carrier 12.

The belt 41 is maintained under tension by means of a tensioning roller 59 and the belts 23,24, can also be kept under constant tension by tensioning rollers 60.

When the cassette 55 carrying the spools 14 and 20 is removed, a micro switch 61 which feeds power to the stepper motor 21 is tripped so that there is no risk of the mechanism of the printing apparatus 10 being actuated without the cassette 55 being in position.

In the event that the carrier feed spool 14 becomes empty, an electronic sensor carried by a clamp 62 past which the carrier 12 passes, will signal the lack of carrier 12 to an operator, and/or disable printing apparatus 10.

The amount of movement of the print head assembly 11 in a direction opposite to that of arrow A i.e. the return movement, is restricted by means of a microswitch carried on a clamp means 63 which senses the print head assembly 11 when returned to its start position, immediately to stop motor 21.

It will be appreciated that by virtue of the print head assembly 11 being mounted on the flexible belts 23,24, and 41 via the mounting structure T, the assembly 11 is able to float to a smaller degree about the central axis of post 46. The roller 44 mounted at the rear of the printing assembly 11 engages with the post 46 to restrict other movements.

Hence in the event that the substrate onto which print medium is to be transferred is not exactly at right angles to the array of printing elements mounted by the print head assembly 11, the assembly 11 can move slightly about the central axis of post 46 as the print head assembly 11 is moved towards the substrate by the actuator 50 to accommodate such slight misalignment.

Hence, improved quality of print can be achieved throughout the entire printing operation. In the absence of some means to accommodate misalignment of the substrate, quality of print would tend to suffer over at least some of the area of the substrate onto which information is printed.

The printing apparatus described above may be operated by a method in accordance with the first invention as follows.

In the apparatus described, the print head assembly 11 may comprise at least six, but possibly eight, twelve, or more energisable printing elements per millimetre width of the print head assembly 11, with all of the energisable print elements arranged in a single line array across the printing head assembly 11.

Rather than utilizing all of the printing elements for printing, as the print head assembly 11 is traversed relative to the carrier 12 and substrate, a first set only of the printing elements may be utilized on a first printing operation. For example, when the height of the image to be printed is small (i.e. at least less than half of the width of the carrier 12) in the direction of the print head movement only a first set of adjacent printing elements are utilized whilst the print head assembly 11 is traversed over or otherwise moves over an area of the carrier 12 from its start to end of print positions to transfer pixels of ink from the carrier 12 onto the substrate 22.

At that stage, rather than advancing the carrier 12, the print head assembly 11 is moved as hereinbefore described relative to the carrier 12 back to the start of print position, but the electronically operated clutch between the gear 30*b* and its shaft L is operated so as to isolate the roller R so that the carrier 12 is not advanced. The substrate 22 may be advanced e.g. where on a web, or an entirely fresh substrate may be presented adjacent to the same area of the carrier 12 which was traversed by the print head assembly 11 immediately previously.

To print a second image having a height less than half the width of the carrier 12, the print head assembly 11 is operated to traverse the same area of the carrier 12, but a second set of adjacent printing elements, laterally disposed with respect to the first set, are utilised during printing to transfer pixels of ink from the carrier 12 onto the substrate.

Thus only some of the printing elements, a first set, are utilised the first time the print head assembly 11 traverses the area of the carrier 12, and only some, a second laterally disposed set, different to the first set of printing elements are utilised the second time the print head assembly 11 traverses the same area of the carrier 12. Hence two laterally disposed portions of the area of the carrier 12 are used in the two consecutive printing operations.

At this stage, if the full width of the area of carrier 12 has now been used, when the print head assembly 11 is returned to the start of print position, the clutch between the gear 30*b* and its shaft L is operated to cause the roller R and the take-up spool 20 to rotate so that the carrier 12 is advanced to provide a fresh area of carrier 12 for subsequent printing operations.

The take up spool 20 may have a slipping clutch which permits differential movement between the spool 20 and the drive roller R as the spool 20 becomes filled with used carrier 12.

Thus the amount of carrier 12 utilised for printing will be reduced by half, in this example, assuming that the carrier 12 is advanced after the print head assembly 11 has relatively traversed the area of the carrier 12 for a second time.

Figure 4:
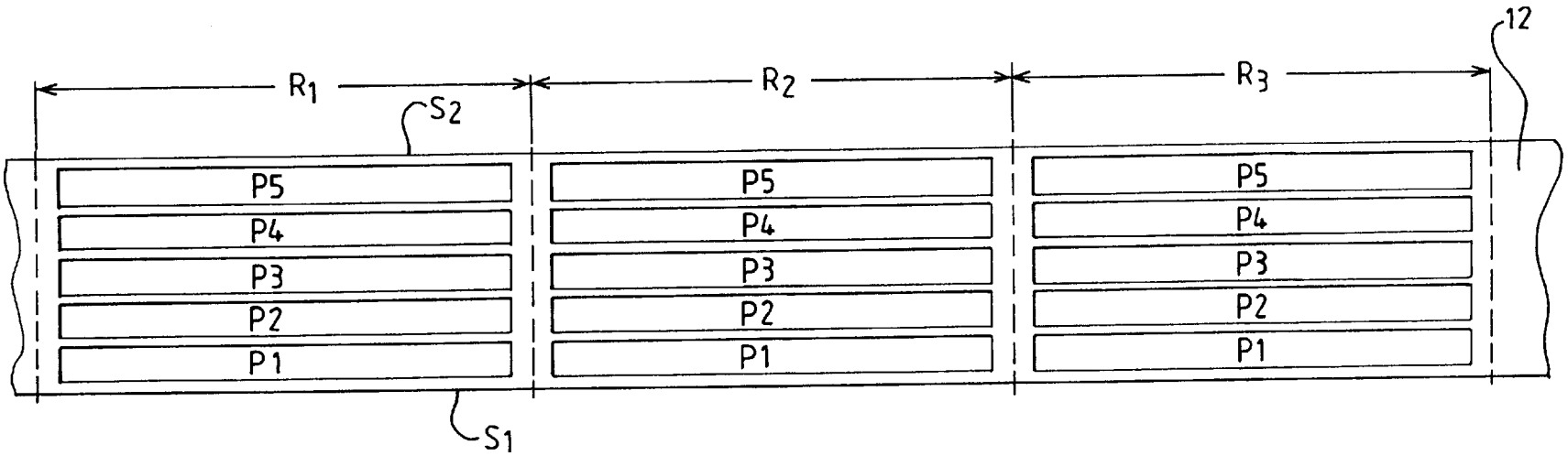
FIG. 4 is an illustrative view of a length of print carrying medium after fifteen printing operations according to the invention have been carried out.

Referring now to FIG. 4, when the height of the image to be printed is sufficiently small for more than two images to be printed one on top of the other using the same area of carrier 12 it might be possible for the print head assembly 11 to traverse or otherwise move over the same area of the carrier 12 more than twice. If this is the case, on each traverse of the same area of the carrier 12 a different set of laterally disposed printing elements will be utilized, thus using different laterally disposed portions of the area of the carrier 12, with a consequent saving in carrier 12.

FIG. 4 illustrates a length of carrier 12 comprising three areas R1, R2 and R3, each of which has been used for printing five images, in five printing operations, thus utilising five laterally disposed ribbon portions P1 to P5 of each area R1 to R3 respectively.

However, it should be noted that in accordance with the invention repeated printing operations may only be performed where the width of the substrate 22 between sides S1 and S2 onto which the image is to be printed is sufficient. Thus before commencing printing the width of substrate 22 available for printing may be determined and those printing elements, if any, which would print outside the available width disabled. The printing operation process may then be repeated until the number of adjacent printing elements available for a further printing operation is too few to print an image of the required width, and then the carrier 12 may be moved on to provide a fresh carrier area.

Where the print head assembly 11 traverses the same area R1 to R3 of the carrier 12 more than twice, it will be appreciated that for each such traverse, fresh substrate 22, being either a fresh area of substrate 22, or an entirely different substrate 22, would need to be presented adjacent to that area of the carrier 12.

Various modifications may be made to the apparatus described with reference to the drawings, as follows.

For example, although the printing apparatus 10 described has been of the type which utilises a carrier 12 carrying ink which is deposited by means of thermal printing elements onto a substrate, the invention may be applied to any other printing apparatus having a plurality of selectively operable printing elements to effect printing, such as a dot matrix printer. The print head assembly 11 may incorporate an array being a single line of printing elements as described, or an array being a matrix i.e. multiple lines of such elements.

Although in the arrangement described, the print head assembly 11 is carried via the mounting structures T by three drive belts 23,24,41, to move relative to a base B1 of the apparatus, in another arrangement, less than three drive belts, or more than three drive belts, may be provided.

In place of drive belts, any other suitable endless loop members, such as chains, could be used to provide a transmission and mounting for the print head assembly 11, or indeed any other suitable flexible or rigid drive member or members which is/are able to provide drive to, and a means of mounting the print head assembly 11, could be used.

Although it is preferred for single stepper motor 21 to be used as a motive means for the printing apparatus 10, with suitable logic control e.g. utilising a computer, if desired more than one stepper motor 21 or other motive means may be provided. For example a separate motor may be provided to drive the drive roller R and take up spool 20 for the carrier 12.

Any alternative means to the piston and cylinder arrangement 50 for effecting movement of the print head assembly 11 towards the substrate, may be provided.

Although the invention has been described with reference to an apparatus in which the print head assembly 11 moves relative to the carrier 12 of print medium, and substrate during printing i.e. relative to a base B1, the invention may be applied to an apparatus of the type in which the print head is at a fixed position relative to a base B1, and the carrier 12 carrying print medium, and the substrate are together moved relative to the print head during printing. In such an embodiment, rather than a print head assembly 11 moving back to a start position of an area of the carrier in order relatively to traverse or otherwise move relative to the carrier a second time, the carrier may be arranged to be moved back relative to the print head assembly whilst fresh substrate is presented adjacent that area of the carrier, and the carrier and fresh substrate is traversed past the fixed print head assembly a second, and where appropriate, further, times.

Figure 5:
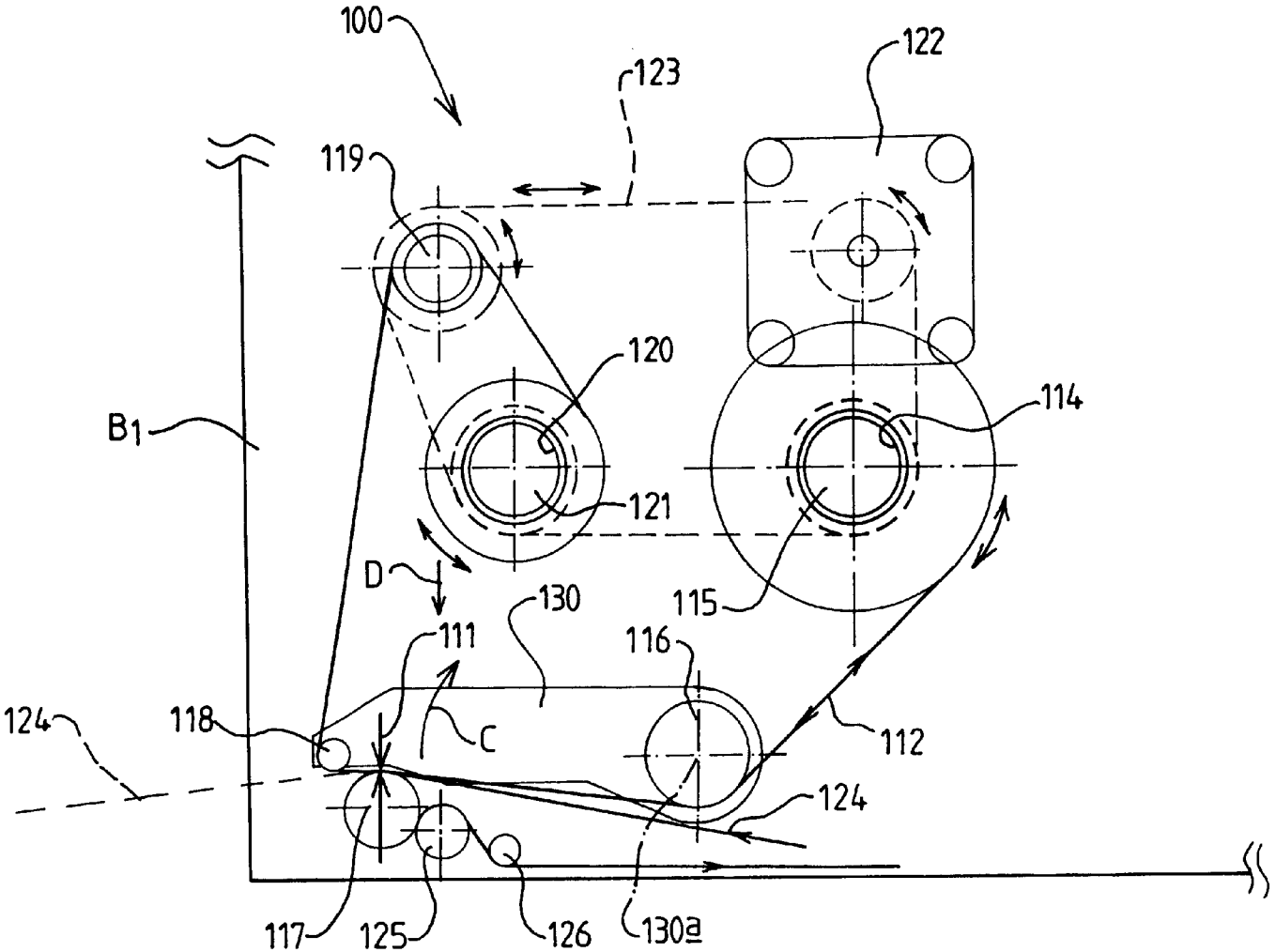
FIG. 5 is a plan view of part of an alternative embodiment of a printing apparatus in accordance with the invention.

Referring now to FIG. 5, a partial view of one embodiment of such an apparatus 100 shows carrier path and drive components. A carrier 112 carrying the ink is provided on a supply spool 114 carried on a hub 115, the carrier 112 passing around a carrier guide path comprising guide roller 116, print head roller 117 against which the print head 111 exerts a force during printing, guide roller 118, carrier drive roller 119, which is operable to drive the carrier 112 and is solely responsible for the amount of carrier 112 movement in either direction, as hereinafter explained. The carrier is then guided on to a take-up spool 120 carried on a hub 121. Supply spool 114, carrier drive roller 119, and take-up spool 120 are driven from a single motive means 122, which in this example is a two-way stepper motor, via a drive and timing belt 123. Spool 114 is driven through a one-way clutch and slip clutch and spool 120 is driven through a one way clutch and slip clutch, the one way clutches operating in tandem such that the two clutches are operable so that when the stepper motor 122 is operated so as to move the timing belt 122 in a clockwise direction as seen in FIG. 4, the take up spool 120 is driven, whilst spool 114 is not driven. Thus carrier 112 may be paid out from the supply spool 114 and taken up onto spool 120. Conversely, if stepper motor 122 is operated so as to move the timing belt 123 in an anticlockwise direction as seen in FIG. 4, the supply spool 114 is driven so as to rotate anticlockwise and take-up carrier 112 onto it, whilst spool 120 is not driven and carrier 112 can be paid out from spool 120 for a purpose hereinafter described.

Additionally, slip clutches are provided for each of these spools 114 and 120 to accommodate differential movement between the spools 114 and 120 as increasingly, carrier is fed out from the supply spool 114 onto the take-up spool 120. The slip clutches also provide slight resistance (drag) when the respective spools 114,120, are paying out carrier 112.

If desired, at least the one-way clutches may be electrically operated, although simple mechanical devices are adequate to perform this function.

A substrate 124 is supplied from a supply spool (not shown) and passes between the carrier 112 and print head roller 117. Particularly if the substrate 124 consists of labels on a carrier, the path can continue around the print head drive roller 117, around a nip roller 125 and a guide roller 126. If the substrate is of another form such as polythene film, the path may continue in substantially the same direction, as indicated by chain line 127. The substrate 124 is driven by a second motive means (not shown) so that the substrate 124 moves in synchronism with the carrier 112 past the print head assembly which is indicated by arrow 111.

Movement of the substrate 124 may be continuous or intermittent as desired.

During printing, the stepper motor 122 drives the timing belt 123 in a clockwise direction, the one-way clutch and slip clutch of spool 114 offers only slip/drag resistance to clockwise rotation and spool 114 acts as a supply spool. At the same time, the one way clutch and slip clutch of spool 120 allow spool 120 to be driven with carrier drive roller 119 in a clockwise direction so that the carrier 112 is taken up on to spool 120. By virtue of the slip clutch on the take-up spool 120, the actual amount of carrier 112 which traverses the print head 111, is governed entirely by the carrier drive roller 119 which is directly driven via belt 123 from the motor 122, and preferably comprises a rubber coated roller which gives good stiction with the carrier 112.

After completion of the first printing operation using an area of carrier 112, the print head assembly 111 is pulled back a small distance, in the order of half to one millimetre, from the carrier 112 in the direction of arrow C, thus releasing the pressure exerted on roller 117 during printing. This is achieved as the print head assembly 111 is mounted on an arm 130 which is rotatable about axis 130a of idler roller 16. The arm 130 is spring biased by a spring wound about the central axis 130 of idler roller 116, or otherwise, to urge the arm 130 away from the reaction roller 117.

The arm 130 and hence the print head 111, can be moved against the force of that spring by a pneumatically operated actuator which acts on the arm 130 in the direction of arrow D. Other suitable arrangements are no doubt possible.

The substrate 124 is then driven on so that an area of fresh substrate is provided adjacent to the print head 111. At the same time, the stepper motor 122 drives the timing belt 123 in an anticlockwise direction, the one way and slip clutches of spool 120 offering only slip/drag resistance to carrier 112 being paid out from spool 120 so that spool 120 acts as a supply spool whilst the one-way and slip clutches of spool 114 causes the spool 114 to be driven so that spool 114 acts as a pick-up spool. However, the amount of carrier 112 driven is again governed by the carrier drive roller 119. By this means, the same area of carrier 112 from which pixels of ink were removed during the previous printing operation can be aligned with the print head 111 and fresh substrate in preparation for a second printing operation.

This process may be repeated as often as required for an area of carrier 112. When that area of carrier 112 has been fully used, the carrier 112 is not wound back as the substrate 114 is wound on, but a first printing operation is carried out using a fresh area of carrier 112.

The operation of the two-way stepper motor 122 and the second stepper motor which drives the substrate 124, must be accurately coordinated. This may be achieved by mechanical means but is most conveniently provided by means of computer control. Alternatively, the stepper motor 122 may be arranged to drive the substrate.

In each case, the print head assembly 111, where the printing elements are energised thermally to transfer pixels of print medium i.e. ink from the carrier carrier 112 onto the substrate, control is preferably achieved by a computer, together with the relative movements of the print head and/or carrier and/or substrate as appropriate to cause either selective printing elements to be energised during each print operation, or for all or substantially all of the printing elements to be used during each printing operation but the printing elements are only energised in selected pixel row positions during each printing operation to enable the same area of carrier 112 or other carrier respectively to be used to print information, by a method as described in detail above with reference to the embodiment of FIGS. 1 to 3.

The mechanism of FIG. 4, although ideal for performing a method of the first aspect of the invention, may be used in other apparatus where it is desired to move carrier in an appropriate direction to the direction the carrier and substrate move during printing.

What is claimed is:

1. A method of printing utilising a printing apparatus having a print head with an array of printing elements each of which is individually selectable in a plurality of pixel row positions along an adjacent substrate to transfer a pixel of print medium from a carrier onto the adjacent substrate, the array extending laterally with respect to a direction of relative movement between the carrier and substrate, and the print head, wherein the method includes the steps of (a) carrying out a first printing operation by means of causing relative movement between the substrate and carrier, and the print head, such that the print head moves relative to a first area of the carrier from a start position to an end position whilst printing elements from a first set of adjacent printing elements of the laterally extending array are selected to transfer a first set of pixels of print medium from the area of the carrier onto the substrate to produce an image having height less than one half of the width of the carrier;

(b) causing relative movement between the print head and the carrier to reposition the print head at the start position of the carrier;

(c) causing relative movement between the carrier and the substrate to present fresh substrate adjacent to the area of the carrier, and (d) carrying out a second printing operation by means of causing relative movement between the fresh substrate and carrier, and the print head, such that the print head moves again relative to the area of the carrier from the start position to the end position whilst printing elements from a second set of adjacent printing elements laterally disposed with respect to the first set of adjacent printing elements are selected to transfer a second set of pixels of print medium from the area of the carrier onto the fresh substrate, to produce a second image having a height less than one half of the width of the carrier.

2. A method according to claim 1 wherein the second set of printing elements is laterally disposed with respect to the first set of printing elements, such that during printing of the first image pixels of print medium are removed from a first portion of the area of the carrier, the first erea of the carrier being disposed closer towards one side of the carrier than a second portion of the area of the carrier from which pixels of print medium are removed during printing of the second image, the second portion being laterally disposed with respect to the first portion.

3. A method according to claim 1 wherein the method includes the step of determining the width of the substrate available for printing, and hence the printing elements of the array which are available for printing.

4. A method according to claim 3 wherein the method further includes carrying out a subsequent printing operation by (b) causing relative movement between the print head and the carrier to replace the print head at the start position of the carrier;

(c) causing relative movement between the carrier and the substrate to present fresh substrate adjacent to the area of the carrier, and (d) carrying out a subsequent printing operation by means of causing relative movement between the fresh substrate and carrier, and the print head, such that the print head moves again relative to the area of the carrier moves from the start position to the end position whilst printing elements from a further set of adjacent printing elements laterally disposed with respect to the previously used sets is selected to transfer a subsequent set of pixels of print medium from the area of the carrier onto the fresh substrate, to produce a further image of a height less than one half of the width of the carrier, until there are insufficient available printing elements left to enable a further set of adjacent pixels to be selected to produce a further image.

5. A method according to claim 1 wherein after each printing operation the print head is moved away from the carrier and substrate and held a short distance away from the carrier whilst the steps of causing relative movement between the print head and carrier to replace the print head at the start position of the carrier, and causing relative movement between the carrier and the substrate such that fresh substrate is presented adjacent to the area of the carrier, are performed, and then the print head is moved back towards the carrier and fresh substrate.

6. A method according to claim 1 where the relative movement between the substrate and carrier, and the print head, is produced by movement of the print head whilst the substrate and carrier are held generally stationary relative to a base.

7. A method according to claim 1 wherein the relative movement between the substrate and carrier, and the print head, is produced by movement of the substrate and carrier whilst the print head is held generally stationary relative to a base.

8. A method according to claim 1 wherein the printing elements are arranged in a single line array.

9. A method according claim 1 wherein the printer is a thermal printer, the printing elements being heating elements, and the carrier, being a print ribbon with a layer of thermally sensitive ink for deposition on an adjacent substrate.

10. A printing apparatus for performing a method of printing according to any one of the preceding claims, the printing apparatus having a print head with an array of printing elements each of which is individually selectable in a plurality of pixel row positions along an adjacent substrate to transfer a pixel of print medium from a carrier onto the adjacent substrate, the array extending laterally with respect to a direction of relative movement between the carrier and substrate, and the print head, and the printing apparatus further including means for carrying out a first printing operation by means of causing relative movement between the substrate and carrier, and the print head, such that the print head moves relative to a first area of the carrier from a start position to an end position whilst printing elements from a first set of adjacent printing elements of the laterally extending array are selected to transfer a first set of pixels of print medium from the area of the carrier onto the substrate to produce an image having height less than one half of the width of the carrier, means to cause relative movement between the print head and the carrier to reposition the print head at the start position of the carrier, means to cause relative movement between the carrier and the substrate to present fresh substrate adjacent to the area of the carrier, and means to carry out a second printing operation by means of causing relative movement between the fresh substrate and carrier, and the print head, such that the print head moves again relative to the area of the carrier from the start position to the end position whilst printing elements from a second set of adjacent printing elements laterally disposed with respect to the first set of adjacent printing elements are selected to transfer a second set of pixels of print medium from the area of the carrier onto the fresh substrate, to produce a second image having a height less than one half of the width of the carrier.

11. A method of printing comprising providing a printhead having a plurality of printing elements arranged in a lateral array over a ribbon, the print head and ribbon being arranged for relative movement while controllably energizing the elements to deposit print from the ribbon onto a substrate, printing an image onto a first substrate utilizing a first set of said of printing elements to print an image less than the width of the carrier, and without substantially advancing the carrier ribbon, consecutively printing a second image onto a second substrate utilizing a second set of printing elements to print an image less than half the width of the carrier, the second set of printing elements being laterally disposed with respect to the first set.

* * * * *